United States Patent [19]

Sato et al.

[11] Patent Number: 4,735,703

[45] Date of Patent: Apr. 5, 1988

[54] METHOD OF INCREASING THE CONCENTRATION OF STRAIGHT CHAIN PARAFFIN MATERIAL

[75] Inventors: Atsushi Sato, Tokyo; Yoshikazu Murai, Yokohama; Tatsuo Yamaguchi, Hino; Kanji Mochizuki; Kunio Sugisawa, both of Yokohama, all of Japan

[73] Assignee: Nippon Petrochemicals Company, Limited, Tokyo, Japan

[21] Appl. No.: 731,834

[22] Filed: May 8, 1985

[30] Foreign Application Priority Data

May 16, 1984 [JP] Japan ..... 59-96687

[51] Int. Cl.[4] ..... C10G 11/08

[52] U.S. Cl. ..... 208/25; 208/51; 208/50; 585/717; 585/258; 585/532

[58] Field of Search ..... 208/14, 25, 50, 51, 208/55, 46, 49, 52 R, 67, 68, 71, 73, 131, 310 Z, 26, 106; 585/717, 727, 258, 464, 727, 532

[56] References Cited

U.S. PATENT DOCUMENTS

| | | | |
|---|---|---|---|
| 1,960,625 | 5/1934 | Egloff | 208/71 |
| 2,304,189 | 12/1942 | McGlen | 208/71 X |
| 2,366,699 | 1/1945 | Crockett | 208/51 |
| 2,623,009 | 12/1952 | Hearby | 208/50 |
| 2,999,857 | 9/1961 | Hoppe | 208/25 |
| 3,238,117 | 3/1966 | Arey, Jr. et al. | 208/51 X |
| 3,308,053 | 3/1967 | Kelley et al. | 208/67 |
| 4,259,169 | 3/1981 | Gale et al. | 208/25 X |
| 4,317,712 | 3/1982 | Farcasiv | 208/46 |

*Primary Examiner*—John Doll
*Assistant Examiner*—Glenn Caldarolo
*Attorney, Agent, or Firm*—Scully, Scott, Murphy & Presser

[57] ABSTRACT

Concentrations of straight chain material are material are increased by treating a thermal-cracked oil distillate boiling in the range of 120° to 290° C. and containing aliphatic olefins, at a temperature of 0° to 330° C. in liquid phase in the presence of an acid catalyst, said thermal-cracked oil distillate being obtained from a thermal cracking process of thermally cracking a petrolic heavy residual oil at a temperature not lower than 400° C. and not exceeding 700° C.; and then separating and removing from the reaction mixture heavy components boiling higher than said distillate.

6 Claims, No Drawings

METHOD OF INCREASING THE CONCENTRATION OF STRAIGHT CHAIN PARAFFIN MATERIAL

BACKGROUND OF THE INVENTION

The present invention relates to utilizing, for the production of straight-chain paraffins, a thermal-cracked oil distillate from a thermal cracking process using a petrolic heavy residual oil.

Recently, because of the exhaustion of petroleum resources, heavier crude oils have come to be used, thus giving rise to an increasing tendency of the amount of heavy oils by-produced such as residual oils in distillations. These heavy residual oils are of less industrial value by reason of their high viscosities or high sulfur and metal contents.

On the other hand, such heavy residual oils can be utilized in thermal cracking processes typified by coking, which may be the only utilization mode of those oils. From the heavy residual coking process is obtained a liquid substance, i.e., thermal-cracked oil, as well as coke and gas. Usually, the yield of the thermal-cracked oil in coking is fairly high and so there are obtained large amounts of thermal-cracked oil distillates.

Since the thermal-cracked oil thus produced in a large amount contains a relatively large amount of aliphatic hydrocarbons and does not have a sufficiently high octane number, such oil has heretofore not been used directly for automobile gasoline, for which purpose it is required to be subjected to a further treatment such as a fluid catalytic cracking. At most, it has been used merely as fuel for boilers, etc. Therefore, how to utilize such large amount of thermal-cracked oil is becoming an important subject in the industrial world.

On the other hand, liquid straight-chain paraffins are starting materials of straight-chain alkylbenzenes and long-chain alcohols as surfactant producing materials which are in extremely great demand, and are also starting materials of petroleum proteins. Industrially, liquid straight-chain paraffins have heretofore been obtained mainly by their separation from a kerosene distillate which contains large amounts of straight-chain paraffins according to a molecular sieve process or a urea adduct process. However, such straight-chain paraffins-containing kerosene distillate is becoming difficult to obtain with the recent decrease of paraffin-base crude oils accessability of heavier crude oils.

SUMMARY OF THE INVENTION

In view of the above-mentioned circumstances, it is an object of the present invention to effectively utilize a thermal-cracked oil distillate obtained in a large amount as a by-product, for example, in the coking process which distillate has been found useful merely as fuel for boilers or the like, by treating such thermal-cracked oil distillate with an acid catalyst to reform into a distillate of a higher industrial utilization value, that is, containing large amounts of straight-chain paraffins, and to attain a highly effective utilization of large amounts of heavy residual oils typical of which is petroleum asphalt, by processing those oils.

It is another object of the present invention to provide a straight-chain paraffin producing material which is inexpensive and easy to obtain.

The present invention resides in a straight-chain paraffin producing material obtained by treating a thermal-cracked oil distillate boiling in the range of 120° to 290° C. and containing aliphatic olefins, at a temperature of 0° to 330° C. in liquid phase in the presence of an acid catalyst, said thermal-cracked oil distillate being obtained from a thermal cracking process of thermally cracking a petrolic heavy residual oil at a temperature not lower than 400° C. and not exceeding 700° C.; and then separating and removing from the reaction mixture heavy components boiling higher than the said distillate.

Then, from the thus-obtained straight-chain paraffin producing material there can be obtained straight-chain paraffins economically according to a conventional straight-chain paraffin separating process such as a molecular sieve process or a urea adduct process.

DESCRIPTION OF THE PREFERRED EMBODIMENTS

The petrolic heavy residual oils referred to therein indicate bottom residues in atmospheric distillation, vacuum distillation and thermal or catalytic cracking, and various residues in petroleum refining such as, for example, residual oils in extraction with furfural, propane, pentane, etc., residual oils in reformers, as well as mixtures thereof, in the ordinary sense in the petroleum refining industry.

In the thermal cracking process of the present invention, the cracking temperature should be not lower than 400° C. and should not exceed 700° C. If the cracking temperature is lower than 400° C., a thermal cracking will not occur, and if it exceeds 700° C., regardless of the cracking time, the resultant thermal-cracked oil will contain excess aromatic hydrocarbons which per se are highly reactive, thus permitting an easy production of high polymers such as resins in the treatment with an acid catalyst. A preferable cracking temperature range is from 400° to 600° C., more preferably from 400° to 550° C. The cracking time may vary, depending on the main purpose of the thermal cracking process such as, for example, the production of coke or the reduction in viscosity of the starting heavy oil. For example, the cracking time may be selected in the range of 10 seconds to 50 hours. The cracking may be performed in the presence of steam or other non-reactive gaseous medium. The cracking pressure, which usually is relatively low, is in the range from vacuum to about 50 kg/cm$^2$.

As typical examples of such thermal cracking process for heavy residual oils, mention may be made of the viscosity breaking process and the coking process, as described in the "Hydrocarbon Processing," Vol. 61, No. 9 (September 1982), pp.160–163.

The viscosity breaking process is a thermal cracking process mainly for lowering the viscosity of a feed material which is carried out under relatively mild cracking conditions while suppressing the formation of coke in a tubular heating furnace. It is classified into coil type and soaker type. Usually, the cracked oil leaving the cracking furnace is quenched for suppressing decomposition and coke formation. As concrete processes are included the Lummus process and Shell process.

In the coking process, which is a coke producing process, are included a delayed coking process (examples are UOP process, Foster Wheeler process, M. W. Kellogg process, Lummus process and CONOCO process) in which the residual oil is once heated in a heating furnace for a relatively short time and then fed to a coke drum for forming an agglomerate coke over a relatively long period of time; a fluid coking process (e.g. Exxon process) in which the residual oil is thermally cracked over a high-temperature fluid coke; a flexicoking process (e.g. Exxon process) which comprises the combination of the fluid coking process with the resultant coke gasifying process; and a EUREKA process which carries out not only a thermal cracking but also steam stripping at a relatively low pressure to prepare pitch.

Of the thermal cracking processes referred to above, the coking process is preferred because the sulfur and metal components in the residual oil are concentrated into the resultant coke so the content of these impurities in the cracked oil is relatively small and therefore the refining even after the acid catalyst treatment is relatively easy. Above all, the delayed coking process has been adopted on large scales because an agglomerate coke is obtained which is useful as a carbon source of graphite for electrode, etc. Since the delayed coking process affords a very large amount of cracked by-product oil, if it is utilized effectively by the present invention, it will bring about a great advantage.

The thermal-cracked oils obtained by the above thermal cracking processes contain aliphatic olefins and aromatic hydrocarbons, and the compositions thereof differ according to types of the processes, thermal cracking conditions, kinds of the starting heavy oils, etc. Usually, however, those thermal-cracked oils, which scarcely contain aromatic olefins, mainly contain reactive aliphatic olefins such as n-olefins and iso-olefins in addition to n-paraffins and iso-paraffins, and further contain aromatic hydrocarbons having an alkyl-substituted single ring such as alkyl-benzenes, an alkyl-substituted composite ring such as alkylindanes and alkyltetralins, and an alkyl-substituted fused ring such as alkylnaphthalenes.

Among the distillates from the thermal-cracked oils obtained in the above-described thermal cracking processes, the distillates to be processed in the present invention are those boiling in the range of 120° to 290° C., preferably 150° to 260° C. With distillates boiling outside this range, the effect of the acid catalyst treatment cannot be expected, nor will be obtained industrially useful straight-chain paraffins. It is necessary that the thermal-cracked oil distillates to be processed in the present invention should contain aliphatic olefins. The content of aliphatic olefins is preferably at least 10 wt.% of said distillate because of high yield of straight-chain paraffins.

A typical composition of the thermal-cracked oil distillates which may be used in the invention is 30–70 wt.% paraffins, 10–40 wt.% aliphatic olefins and 5–20 wt.% aromatic hydrocarbons. However, as long as the above-mentioned conditions required of the distillates are satisfied, the thermal-cracked oils may be subjected to fractionation or diluted with unreacted oils recovered after acid treatment.

The foregoing acid catalyst treatment performed so as to result in that the resultant reaction product boils higher than the thermal-cracked oil distillate and can be easily separated by distillation. The heavy fraction produced by the acid catalyst treatment consists principally of oligomers of aliphatic olefins and alkylates of aliphatic olefins and aromatic hydro- carbons.

After the acid catalyst treatment, the heavy fraction produced is separated and removed by, for example, distillation, and the remaining thermal-cracked oil distillate is recovered. The distillate thus recovered has a reduced content of unsaturated compounds such as aliphatic olefins and aromatics and hence an increased content of paraffins, especially straight-chain paraffins, typically not less than 80 wt. % paraffins, of which not less than 30 wt. % are straight-chain paraffins. Thus, this distillate is best suited as a straight-chain paraffin producing material.

In addition to the foregoing acid catalyst treatment for the thermal-cracked oil distillate itself, a mixture of the thermal-cracked oil distillate and, as an aromatic source, various aromatic hydrocarbons or a distillate or distillates containing those aromatic hydrocarbons (all boiling lowar than the thermal-cracked oil distillate) as will be described below may be treated in the same manner, whereby there is obtained a material having a high straight-chain paraffin content.

More specifically, the thermal-cracked oil distillate may be mixed with one or more distillates boiling lower than the thermal cracked oil distillate, selected from (a) a distillate from a thermal-cracked by-product oil obtained by thermally cracking a petrolic light oil at a temperature of 750° to 850° C., (b) a reformate distillate obtained by a catalytic reforming of a petrolic light oil boiling in the range of 50° to 250° C. and (c) aromatic hydrocarbons.

The thermal-cracked by-product oil distillate of the above (a) is obtained when a petrolic light oil is thermally cracked at a temperature of 750° to 850° C. with a view to producing lower olefins such as ethylene and propylene.

As examples of the petrolic light oil are mentioned naphtha, kerosene, light oil, LPG and butane. In consideration of properties of the resultant thermal-cracked by-product oil, naphtha, kerosene and light oil are preferred as starting materials in the above-said thermal cracking because those oils are more suitable for the objects of the present invention.

The method of thermal cracking is not specially limited. Various conventional thermal cracking methods performed in the temperature range of 750° to 850° C., for example, the method using a tubular cracking furnace and the method using a heat-transfer medium, can be adopted.

The thermal-cracked by-product oil distillate obtained from the thermal-cracked product after removal of such object products as olefins and diolefins, e.g. ethylene, propylene and butadiene, which distillate differs depending on the kind of the starting petrolic light oil and thermal cracking conditions, is a distillate having 6 to 10 carbon atoms, containing relatively large amounts of aromatic hydrocarbons and containing 2–10 wt. % paraffins, 3–10 wt. % naphthenes, 55–85 wt. % aromatic hydrocarbons, 2–10 wt. % aliphatic olefins and 2–15 wt. % aromatic olefins. The thermal-cracked by-product oil of the above (a) may be mixed with the thermal-cracked oil distillate directly, that is, in a state containing unsaturated compounds, or after decreasing the content of unsaturated compounds by hydrogenation. Preferably, the unsaturated compounds content is reduced to not more than 0.1 cg/g, more preferably not more than 0.01 cg/g, in terms of bromine number, before the mixing.

The reformate distillate of the above (b) is obtained by a catalytic reforming of a petrolic light oil boiling in the range of 50° to 250° C., e.g. straight-run naphtha. Catalytic reforming has been conducted widely in the fields of petroleum refining and petrochemistry for improving the octane number or for obtaining benzene, toluene, xylene, etc. It is carried out at a temperature of 450° to 510° C. in the presence of hydrogen using a metal catalyst such as platinum, platinum-rhenium, molybdenum oxide or chromium oxide supported on alumina or silica-alumina. As industrial methods, mention may be made of the Platforming of UOP Co. which is a fixed bed type and the Ultraforming of Standard Oil Co. which is also a fixed bed type. In addition, fluidized bed type and moving bed type catalytic reforming methods are also employable. In the catalytic reforming, there mainly occur dehydrogenation and cyclization reaction, as well as isomerization reaction; as a result, the BTX (benzene, toluene and xylene) content increases and the octane number is improved. However, the resultant reformate has a bromine number not more than about 4 and thus contain very small amounts of unsaturated components.

The catalytic reformate distillate typically has 6 to 10 carbon atoms and contains 30–35 wt. % paraffins, 65–70 wt. % aromatic hydrocarbons and 0–2 wt. % olefins.

Further, the aromatic hydrocarbons of the above (c) which may be mixed with the thermal-cracked oil distillate are typically those contained in the thermal-cracked by-product oil distillate of the above (a) and the catalytic reformate distillate of the above (b). Examples are aromatic hydrocarbons having 6 to 9 carbon atoms such as benzene, toluene, xylene, ethylbenzene, propylbenzene and trimethylbenzene. Mixtures thereof such as aromatic distillates are also employable. A preferred example of such distillate is a $C_9$ aromatic distillate which is obtained together with BTX (benzene, toluene and xylene) distillate in the production of BIX distillate from the foregoing thermal-cracked by-product oil (a), catalytic reformate (b), or a mixture thereof. The production of BTX distillate has been performed on a large scale in the petrochemical field, and usually BTX distillate is obtained by separation according to a solvent extraction process or extractive distillation process. As typical examples of such solvent extraction process are mentioned Udex prc,cess (Dow process) which employs diethylene glycol or triethylene glycol as the extraction solvent, and Sulfolane process (Shell process) which employs sulfolane as the extraction solvent. Usually, this separating operation is preceded by hydrogenation to remove unsaturated components for preventing the apparatus from being blocked by polymerization of the unsaturated components. The above aromatic distillate is preferable because it is obtained in a large amount together with BTX distillate and there is no effective use thereof at present, that is, it can be obtained inexpensively.

The thermal-cracked by-product oil distillate (a), reformate distillate (b) and aromatic hydrocarbons (c) may be used in combination.

It is necessary that the thermal-cracked byproduct oil distillate (a), reformate distillate (b) and hydrocarbons (c) to be mixed with the thermal-cracked oil distillate should all be lower in boiling point than the thermal-cracked oil distillate to the extent that they can be separated by distillation. If they are not lower in boiling point than the thermal-cracked oil distillate, it will become difficult to perform the subsequent separation by distillation and aromatic hydrocarbons will be incorporated in the straight-chain paraffin producing material; moreover, the acid catalyst treatment will become less effective.

As to the mixing ratio, the proportion of the thermal-cracked by-product oil distillate (a), reformate oil distillate (b), aromatic hydrocarbons (c), or a mixture thereof, is not more than 90 wt. %, preferably not more than 80 wt. %. A proportion thereof exceeding 90 wt. % is not desirable because the acid catalyst treatment would become no longer effective. The lower limit is not specially limited.

Preferred examples of the acid catalyst used in the acid catalyst treatment are solid acid catalysts, so-called Friedel-Crafts catalysts, mineral acids and organic acids. More concrete examples include solid acid catalysts such as acid clay minerals, e.g. acid clay and activated clay, amorphous or crystalline silica-alumina, $AlF_3.Al_2O_3$ and strong acid type ion-exchange resins; Friedel-Crafts catalysts such as HF, $AlCl_3$, $BF_3$ and $SnCl_4$ or their complex; and inorganic and organic acids such as sulfuric acid, p-toluenesulfonic acid and trifluoromethanesulfonic acid.

The reaction may be carried out according to any of the batch process, semi-batch process and continuous flow process. But, in the case of using a solid acid, the continuous flow process is preferred.

The acid catalyst is used in an amount of 0.2 to 20 wt. %, preferably 1 to 10 wt. %, based on the weight of the distillate in the batch process. In the flow process, it is treated at a liquid hourly space velocity (LHSV) of 0.1 to 20, preferably 0.5 to 10. The reaction temperature is in the range of 0° to 300° C., preferably 5° to 250° C. The treating time, which differs according to reaction conditions such as the amount of catalyst used, reaction temperature and feed composition, should be long enough to complete the reaction. Usually, it is selected in the range of 1 to 24 hours. The reaction pressure is not specially limited if only it can maintain the reaction system in liquid phase.

After the acid catalyst treatment, the resultant heavy components boiling highar than the thermal-cracked oil distillate are separated and removed by distillation which may be a precise multi-stage fractional distillation if necessary. Where the thermal-cracked by-product oil distillate (a), reformate distillate (b) and/or hydrocarbons (c) are mixed with the thermal-cracked oil distillate and then subjected to the acid catalyst treatment, they are removed by distillation after the treatment together with the resultant heavy components. The distillate thereby obtained, boiling in the range of 120° to 290° C., has a reduced content of most olefins and aromatics and an increased content of paraffins such as straight-chain paraffins. Thus, the thermal-cracked oil distillate is reformed by the acid catalyst treatment into a desirable straight-chain paraffin producing material.

The straight-chain paraffin producing material thus obtained may be subjected to a catalytic hydrogenation treatment if necessary in separating straight-chain paraffins therefrom. This catalytic hydrogenation treatment may be performed after the acid catalyst treatment or after separation and removal of the resultant heavy components and the hydrocarbons mixed with the thermal-cracked oil distillate.

In the catalytic hydrogenation treatment there may be used any conventional hydrogenation catalyst. For example, metallic catalysts such as Pt, Pd, Ni, Co, Mo, W and Co-Mo, as well as metal oxide catalysts, are employable. Conditions for the catalytic hydrogenation treatment are not specially limited, but usually this treatment is carried out under the conditions of a reaction temperature in the range of 250° to 450° C., a hydrogen pressure in the range of 20 to 100 kg/cm$^2$, a hydrogen/feed oil mole ratio in the range of 0.5 to 20 and an LHSV in the range of 0.1 to 10. After the catalytic hydrogenation treatment, light fractions such as cracked gases are removed by any suitable means such as distillation if necessary.

From the thermal-cracked oil distillate thus treated with an acid catalyst and recovered as straight-chain paraffins producing materials, straight-chain paraffins can be obtained according to any conventional paraffin separating method, e.g. a method using molecular sieves or urea adduct. The molecular sieves indicate a selective adsorbent comprising a natural or synthetic zeolite or aluminosilicate, e.g. calcium aluminosilicate (which comprise substantially uniform porous crystals having molecular order pores). Generally, zeolites are hydrated aluninosilicates having the following general formula:

$$(R_1R'_2)O.Al_2O_3.nSiO_2.mH_2O$$

wherein R is an alkaline earth metal such as calcium, barium or magnesium and R' is an alkali metal such as sodium, potassium or lithium. Various processes have already been proposed for separation of n-paraffins and iso-paraffins, using such molecular sieves. Typical examples are Molex process (U.O.P.), Iso-Siv process (U.C.C.) and TSF process (TEXACO Dev.). Basically, according to these processes, a mixed hydrocarbon feed material is contacted with molecular sieves of 5 Å in gaseous or liquid phase to adsorb straight-chain hydrocarbons and then the straight-chain compounds are desorbed at a low pressure or a high temperature usually with the aid of purge gas or desolvents such as n-pentane or isooctane. In this case, adsorbing and desorbing conditions usually involve temperatures in the range from room temperature to 350° C., preferably 100° to 320° C., and pressures from 1 to 60 kg/cm$^2$ or higher.

The urea adduct process for obtaining straight-chain paraffins utilizes the fact that urea or thiourea forms a crystalline adduct with straight-chain paraffins. More specifically, a saturated aqueous solution or methanol solution of urea is mixed with the feed oil. A mixed water-methanol solution is also employable. Further, if the feed oil is dissolved in methyl ethyl ketone, isobutyl methyl ketone, sec-butyl alcohol or methylene chloride, the formation of adduct will be accelerated. After the formation of adduct, the adduct is separated by filtration and washed by a suitable decomposing solvent, followed by distillation, to obtain straight-chain paraffins. As the decomposing solvent is used a solvent (e.g. isooctane, carbon tetrachloride, benzene) which dissolves only straight-chain paraffins, or a solvent (e.g. water) which dissolves only urea.

The heavy fraction by-produced, which is not higher than 25 cSt in viscosity at 70° C. and not higher than −45° C. in pour point, is employable as a superior iso-paraffinic solvent for industrial use.

The features of the present invention are summarized as follows.

(1) Thermal-cracked oil from a thermal cracking process using a heavy rsidual oil can be utilized effectively, and hence surplus heavy residual oils of low industrial value can be utilized effectively. Thus, the process of the present invention is of great industrial value.

(2) According to the process of the present invention, there can be obtained in high yield from the above thermal-cracked oil straight-chain paraffins of high added value as a starting material in the production of alkyl aromatic hydrocarbons and long-chain alcohols.

(3) The heavy fraction and iso-paraffin fraction by-produced in the process of the present invention are a high-boiling solvent and an aliphatic solvent both having superior characteristics, and thus both main product and by-product are employable effectively, which is an economic advantage.

The following examples are given to further illustrate the present invention.

EXAMPLE 1

From a delayed coking apparatus (cracking conditions: temperature 496° C., residence time 24 hours, pressure 4 kg/cm$^2$) for coking a residual oil in vacuum distillation of such properties as shown in Table 1 obtained from Minas crude oil, there was obtained a thermal-cracked oil in addition to gases and coke as set out in Table 2.

TABLE 1

| Properties of the heavy residual oil | Minas vacuum-distilled bottom residue |
|---|---|
| Specific gravisy (@ 15° C.) API | 20 |
| Asphaltene, wt. % | 2.6 |
| Conradson residual carbon, wt. % | 7.1 |

TABLE 2

| Yield | Yield (wt. %) |
|---|---|
| Butane and light gas | 8 |
| 30°-160° C. (Distillate No. 1) | 13 |
| 160°-260° C. (Distillate No. 2) | 22 |
| 260° C.+ (Distillate No. 3) | 40 |
| Coke | 17 |
| Total | 100 |

Distillate No.2 in the above Table 2 was used as a starting material, whose composition is as shown in Table 3 below.

TABLE 3

| Feed Composition | (Distillate No. 2) 160°-260° C. | |
|---|---|---|
| Bromine number cg/g | 20.2 | |
| Type analysis (wt. %) | | |
| Paraffins | 68.3 | (straight-chain paraffins 32.0 wt. %) |
| Aliphatic olefins | 19.4 | |
| Aromatics | 12.3 | |
| Aromatic olefins | — | |

Then, 40 g. of $AlCl_3$ was added to 4 l, of distillate No.2 followed by treatment at 50° C. for 20 hours according to the batch process. Thereafter, the reaction mixture was treated with an aqueous ammonia solution for neutralization and decomposition of $AlCl_3$, which was removed by washing with water. It was then dehydrated, and components boiling not lower than 260° C. were distilled off to obtain unreacted distillate (2,100 g, 70% yield). This unreacted distillate was found to have a bromine number of 0.8 cg/g and an aromatics content of 2.0% and the balance paraffins, of which straight-chain paraffins were 45%. It can be used as a superior aliphatic solvent directly or after a simple hydro-refining. When this distillate was subjected to adsorption and desorption treatments under the conditions shown in the column "Process A" of Table 4, there were obtained straight-chain paraffins (820 g, 39% yield) of 99% purity.

Then, another portion of the above unreacted distillate was subjected to a hydrogenation treatment using a Co-Mo catalyst under the conditions of hydrogen pressure 50 kg/cm$^2$, reaction temperature 280° C. and one volume feed oil/catalyst/hr. After the hydrogenation treatment, the light fraction formed by decomposition was distilled off, and the hydrogenated unreacted distillate was recovered. The percent recovery was 99%. It proved to have a bromine number of 0 cg/g and an aromatics content of 2.0% and the balance paraffins, of which 45% were straight-chain paraffins. This reaction product was then treated under the conditions shown in the column "Process B" of Table 4 to obtain straight-chain paraffins (860 g, 41% yield) of 99% purity.

TABLE 4

| | Conditions for recovering straight-chain paraffins | |
|---|---|---|
| | Process A | Process B |
| Molecular Sieves | Molecular Sieves 5A (20–50 mesh) | |
| Adsorbing Conditions | Temperature 310° C. Pressure 1.8 Kg/cm$^2$ | Temperature 180° C. Pressure 21 Kg/cm$^2$ |
| Desorbent | n-heptane | n-pentane/isooctane 1:1 mixture |

EXAMPLE 2

40 ml. of $BF_3.H_2O$ was added to 4 l of distillate No.2 in Table 1 obtained in Example 1 followed by treatment at 50° C. for 2 hours according to the batch process. Then, the reaction mixture was treated with an aqueous ammonia solution for neutralization and decomposition of $BF_3$, which was removed by washing with water. It was then dehydrated, and components boiling not lower than 260° C. were distilled off to obtain unreacted distillate (2,280 g, 76% yield). This unreacted distillate was found to have a bromine number of 1.2 cg/g and an aromatics content of 2.6% and the balance paraffins, of which straight-chain paraffins were 45%. In the same way as in Example 1, this unreacted distillate was subjected to a catalytic hydrogenation treatment and then treated according to Process B in Table 4 to obtain 945 g. (42% yield) of straight-chain paraffins of 99% purity.

EXAMPLE 3

The Minas vacuum-distilled bottom residue described in Example 1 was subjected to a thermal cracking under the conditions of residence time 1.5 hours, temperature 485° C. and pressure 1.5 kg/cm$^2$. The resultant thermal-cracked oil was rectified to obtain a thermal-cracked oil distillate having a boiling range of 100° to 300° C. (containing 85% components boiling in the range of 120°–290° C., the aliphatic olefins, paraffins and aromatics proportions being 69.5%, 20.1% and 10.4% respectively, straight-chain paraffins 31.2%). The yield was 37%.

The thermal-cracked oil distillate was treated using a silica-alumina catalyst by a fixed-bed flow process under the conditions of reaction temperature 200° C. and one volume feed oil/catalyst volume/hr. The reaction solution was subjected to a catalytic hydrogenation treatment using a Co-Mo catalyst under the conditions of hydrogen pressure 50 kg/cm$^2$, reaction temperature 200° C. and one volume feed oil/catalyst volume/hr.

After the hydrogenation treatment, unreacted distillate boiling in the range of 120° to 290° C. was obtained by distillation (71% yield), which was found to have a bromine number of 0 cg/g and an aromatics content of 2.0% and the balance paraffins, of which 42% were straight-chain paraffins. This distillate was then treated according to Process B in Table 4 described in Example 1 to obtain straight-chain paraffins of 99% purity (40% yield).

EXAMPLE 4

Distillate No.2 in Table 2 obtained in Example 1 was further subjected to fractional distillation to obtain a distillate (hereinafter referred to as distillate 2') boiling in the range of 180° to 220° C. and having such composition as set forth in Table 5 below.

TABLE 5

| | Feed Composition | |
|---|---|---|
| | Distillate 2' b.p. 180°–220° C. | |
| Bromine number | 34.0 | |
| Type analysis (wt. %) | | |
| Paraffins | 60.1 | (straight-chain paraffins 29.1 wt. %) |
| Aliphatic olefins | 29.1 | |
| Aromatics | 10.8 | |
| Aromatic olefins | — | |

Further, a by-product oil distillate boiling in the range of 61° to 250° C. was distilled out from a tubular thermal cracking furnace for thermal cracking of naphtha at 780° to 810° C. for the production of ethylene and propylene. The by-product oil distillate contained large amounts of aromatic hydrocarbons such as benzene, toluene, xylene and styrene in addition to acetylenes and diolefins.

Then, the distillate was subjected to a hydrogenation treatment using a Unifining two-stage hydrogenation apparatus for the removal of unsaturated components such as diolefins and for desulfurization. As a catalyst there was used a cobalt-molybdenum catalyst supported on alumina. The hydrogenation conditions were a temperature of 220° C. and a pressure of 50 kg/cm$^2$ in the first stage and 330° C. and 50 kg/cm$^2$ in the second stage.

The thermal-cracked by-product oil distillate thus hydrogenated was found to have a sulfur content not higher than 0.01% and an unsaturated components content not higher than 0.01%. This distillate will be hereinafter referred to as distillate (a).

In the next place, a reformate was obtained from a Platforming apparatus for a catalytic reforming of naphtha boiling in the range of 50° to 250° C. by the use of a platinum catalyst in the presence of hydrogen at a reaction temperature of 470° C. and pressure of 50 kg/cm$^2$ for the production of gasoline and benzene, toluene or xylene. This reformate also contained large amounts of aromatics, but had a less content of unsaturated components than that of the foregoing thermal-cracked by-product oil distillate. Its bromine number was found to be 0.2 cg/g. This reformate will hereinafter be referred to as distillate (b).

Then, 90 vol. % of the reformate distillate (b) having a boiling range of 60° to 250° C. was mixed with 10 vol. % of a fraction having the same boiling range as the distillate (a) (thermal-cracked by-product oil distillate), and the mixture was fed to a Udex extractor to recover an aromatics distillate. More specifically, the mixture was fed to a middle portion of an aromatics extraction column, while ethylene glycol as an extraction solvent was fed from the top of the column, and thus a countercurrent extraction was performed. After refining of the extract, there were produced benzene, toluene and xylene by fractionation. At this time, an aromatic distillate having a boiling range of 150° to 250° C. was by-produced as a distillate of $C_9$ or more. This aromatics distillate, containing 99% or more aromatics, will be hereinafter referred to as distillate (c). Table 6 below shows properties of a fraction (distillate (c')) having a boiling range of 160° to 180° C. from the distillate (c).

TABLE 6

| Properties | Boiling Range 160°-180° C. (distillate c') |
|---|---|
| Specific gravity @ 60° F./60° F. | 0.876 |
| Saybolt color | above +30 |
| Flash point (PMCC) | 45 |
| Blended aniline point, °C. | 13 |
| Aromatics (vol. %) | 99.5 |
| Distillation property (ASTM) | |
| Initial boiling point, °C. | 160 |
| Dry point, °C. | 176 |

Table 7 below shows the composition of the thus-extracted xylene distillate (c'') having a boiling ange of 135° to 145° C.

TABLE 7

| Composition of xylene distillate (c'') | |
|---|---|
| Component Name | Mixing Ratio |
| Ethylbenzene | 55.8 wt. % |
| p-Xylene | 10.4 wt. % |
| m-Xylene | 20.7 wt. % |
| o-Xylene | 11.8 wt. % |
| Others | 1.3 wt. % |

5.0 g. of anhydrous aluminum chloride was added to a mixture of 450 ml. of the distillate 2' and 50 ml. of the distillate (c'), and stirring was made at 185° C. for 1.5 hours according to a batch process. Thereafter, the reaction mixture was treated with an aqueous ammonia solution for neutralization and decomposition of the catalyst, which was removed by washing with water. It was then dehydrated, and unreacted distillate (c') and components boiling not lower than 220° C. were distilled off to obtain unreacted distillate (280 g, 82% yield) of the distillate 2'. This unreacted distillate was found to have a bromine number of 1.5 cg/g and an aromatics content of 6.5% and the balance paraffins, of which 43% were straight-chain paraffins. In the same way as in Example 1 this unreacted distillate was subjected to a catalytic hydrogenation treatment and then treated according to Process B in Table 4 to obtain 112 g. (40% yield) of straight-chain paraffins of 99% purity.

EXAMPLE 5

5.0 g. of anhydrous aluminum chloride was added to a mixture of 250 ml. of the distillate 2' obtained in Example 4 and 250 ml. of the distillate (c') obtained in Example 4, and stirring was made at 185° C. for 1.5 hours according to a batch process. Thereafter, the reaction mixture was treated with an aqueous ammonia solution for neutralization and decomposition of the catalyst, which was removed by washing with water. It was then dehydrated, and unreacted distillate (c') and components boiling not lower than 220° C. were removed by distillation to obtain unreacted distillate (130 g, 65% yield) of the distillate 2'. This unreacted distillate was found to have a bromine number of 0.8 cg/g and an aromatics content of 8.2% and the balance paraffins, of which 39% were straightchain paraffins. In the same way as in Example 1 this unreacted distillate was subjected to a catalytic hydrogenation treatment and then treated according to Process B in Table 4 to obtain 47 g. (36% yield) of straight-chain paraffins of 99% purity.

EXAMPLE 6

5.0 g. of anhydrous aluminum chloride were added to a mixture of 100 ml. of the distillate 2' obtained in Example 4 and 400 ml. of the distillate (c') obtained in Example 4, and stirring was made at 185° C. for 1.5 hours according to a batch process. Thereafter, the reaction mixture was treated with an aqueous ammonia solution for neutralization and decomposition of the catalyst, which was removed by washing with water. It was then dehydrated, and unreacted distillate (c') and components boiling not lower than 220° C. were removed by distillation to obtain unreacted distillate (54 g, 67% yield) of the distillate 2'. This unreacted distillate was found to have a bromine number of 0.1 cg/g and an aromatics content of 9.3% and the balance paraffins, of which 38% were straight-chain paraffins. In the same way as in Example 1 this unreacted distillate was subjected to a catalytic hydrogenation treatment and then treated according to Process B in Table 4 to obtain 19 g. (35% yield) of straight-chain paraffins of 99% purity.

EXAMPLE 7

5.0 g. of anhydrous aluminum chloride was added to a mixture of 400 ml. of the distillate 2' obtained in Example 4 and 100 ml. of a 160°-180° C. boiling distillate of the distillate (a) (thermal-cracked by-product oil distillate) obtained in Example 4, and stirring was made at 185° C. for 1.5 hours according to a batch process. Thereafter, the reaction mixture was treated with an aqueous ammonia solution for neutralization and decomposition of the catalyst, which was removed by washing with water. It was then dehydrated, and unreacted distillate (a) and components boiling not lower than 220° C. were removed by distillation to obtain unreacted distillate (199 g, 62% yield) of the distillate 2'. This unreacted distillate was found to have a bromine number of 1.3 cg/g and an aromatics content of 6.7% and the balance paraffins, of which 43% were straight-chain paraffins. In the same manner as in Example 1 this unreacted distillate was subjected to a catalytic hydrogenation treatment and then treated according to Process B in Table 4 to obtain 82 g. (41% yield) of straight-chain paraffins of 99% yield.

EXAMPLE 8

5.0 g. of anhydrous aluminum chloride was added to a mixture of 400 ml. of the distillate 2' obtained in Example 4 and 100 ml. of a 160°-180° C. boiling distillate of the distillate (b) (reformate distillate) obtained in Example 4, and stirring was made at 185° C. for 1.5 hours according to a batch process. Thereafter, the reaction mixture was treated with an aqueous ammonia solution for neutralization and decomposition of the catalyst, which was removed by washing with water. It was then dehydrated, and unreacted distillate (b) and components boiling not lower than 220° C. were removed by distillation to obtain unreacted distillate (196 g, 61% yield) of the distillate 2'. This unreacted distillate was found to have a bromine number of 1.0 cg/g and an aromatics content of 6.4% and the balance paraffins, of which 43% were straight-chain paraffins. In the same manner as in Example 1 this unreacted distillate was subjected to a catalytic hydrogenation treatment and then treated according to Process B in Table 4 to obtain 81 g. (41% yield) of straight-chain paraffins of 99% purity.

EXAMPLE 9

8.4 g. of anhydrous aluminum chloride was added to a mixture of 400 ml. of the distillate 2' obtained in Example 4 and 600 ml. of a 135°-145° C. boiling xylene fraction obtained in Example 4, and stirring was made at 80° C. for 1 hour according to a batch process. Thereafter, the reaction mixture was treated with an aqueous ammonia solution for neutralization and decomposition of the catalyst, which was removed by washing with water. It was then dehydrated, and unreacted xylene fraction and components boiling not lower than 145° C. were removed by distillation to obtain unreacted distillate (200 g, 62% yield) of the distillate 2'. This unreacted distillate was found to have a bromine number of 0.2 cg/g and an aromatics content of 6.5% and the balance paraffins, of which 39% were straight-chain paraffins. In the same manner as in Example 1 this unreacted distillate was subjected to a catalytic hydrogenation treatment and then treated according to Process B in Table 4 to obtain 72 g. (36% yield) of straight-chain paraffins of 99% purity.

EXAMPLE 10

300 ml. of benzene and 600 ml. of anhydrous hydrogen fluoride (purity 99% or more) were placed in a batch type reactor (internal volume: 3 l) cooled at 5° C. and allowed to cool sufficiently with stirring, then a mixture of 400 ml. of the distillate 2' obtained in Example 4 and 300 ml. of benzene was added dropwise over a period of 10 minutes. The stirring was continued for another one hour. Thereafter, the reaction mixture was allowed to stand for separation into oil layer and anhydrous hydrogen fluoride layer. Then, the oil layer was treated with a 10 wt. % aqueous potassium hydroxide solution for neutralization and decomposition of the anhydrous hydrogen fluoride incorporated therein, which hydrogen fluoride was removed by washing with water. It was then dehydrated, and unreacted benzene and components boiling not lower than 220° C. were removed by distillation to obtain unreacted distillate (208 g, 65% yield) of the distillate 2'. This unreacted distillate was found to have a bromine number of 1.0 cg/g and an aromatics content of 9.5% and the balance paraffins, of which 38% were straight-chain paraffins. In the same manner as in Example 1 this unreacted distillate was subjected to a catalytic hydrogenation treatment and then treated according to Process B in Table 4 to obtain 75 g. (36% yield) of straight-chain paraffins of 99% purity.

The above Examples are summarized in Table 8.

TABLE 8

| | | Example 1 | | Example 2 | Example 3 | Example 4 |
|---|---|---|---|---|---|---|
| Feed Composition | Thermal-cracked oil distillate of (A) (vol. %) | 160°-260° C. Boiling Distillate (100) | | | 100°-300° C. Boiling Distillate (100) | 100°-220° C. Boiling Distillate (90) |
| | Hydrocarbons of (B) (vol. %) | — (—) | | — (—) | — (—) | 160°-180° C. Boiling Aromatics Distillate obtained by Solvent Extraction (Distillate c') (10) |
| Acid Catalyst Treatment | Catalyst | $AlCl_3$ 1.3 wt. % | | $BF_3.H_2O$ 1.0 vol. % | Silica · Alumina | $AlCl_3$ 1.3 wt. % |
| | Treating Conditions | 50° C. × 20 hr | | 50° C. × 2 hr | 200° C. | 185° C. × 1.5 hr |
| Resultant Straight-chain Paraffin Producing Material | Yield | 70% | | 76% | 71% | 62% |
| | Hydrogenation | Unhydrogenated | Hydrogenated | Unhydrogenated | Hydrogenated | Unhydrogenated |
| | Bromine Number (cg/g) | 0.8 | | 1.2 | 0 | 1.5 |
| | Paraffins (straight-chain)(wt. %) | 97.3 (45.0) | | 96.3 (45.0) | 98.0 (42.0) | 92.1 (43.0) |
| | Olefins (wt. %) | 0.7 | | 1.1 | 0 | 1.4 |
| | Aromatics (wt. %) | 2.0 | | 2.6 | 2.0 | 6.5 |
| Extraction of straight-chain Paraffins | (Method) | Process A | Process B after hydrogenation | Process B after hydrogenation | Process B after hydrogenation | Process B after hydrogenation |
| | Yield (wt. %) | 39.0 | 41.0 | 42.0 | 42.0 | 40.0 |
| | Purity (wt. %) | 99 | 99 | 99 | 99 | 99 |

| | | Example 5 | Example 6 | Example 7 | Example 8 |
|---|---|---|---|---|---|
| Feed Composition | Thermal-cracked oil distillate of (A) (vol. %) | 180°-220° C. Boiling Distillate (50) | (20) | 180°-220° C. Boiling Distillate (90) | (90) |
| | Hydrocarbons of (B) (vol. %) | 160°-180° C. Boiling Aromatics Distillate obtained by Solvent Extraction (Distillate c') (50) | (80) | Thermal-cracked By-product Oil Distillate (Distillate a) (10) | Reformate Distillate (Distillate b) (10) |
| Acid Catalyst Treatment | Catalyst | $AlCl_3$ 1.3 wt. % | | $AlCl_3$ 1.3 wt. % | |
| | Treating Conditions | 185° C. × 1.5 hr | | 185° C. × 1.5 hr | |
| Resultant Straight-chain Paraffin Producing Material | Yield | 65% | 67% | 62% | 61% |
| | Hydrogenation | Unhydrogenated | Unhydrogenated | Unhydrogenated | Unhydrogenated |
| | Bromine Number (cg/g) | 0.8 | 0.1 | 1.3 | 1.0 |
| | Paraffins (straight-chain)(wt. %) | 91.0 (39.0) | 90.7 (38.0) | 92.1 (43.0) | 92.6 (43.0) |
| | Olefins (wt. %) | 0.8 | 0 | 1.2 | 1.0 |

TABLE 8-continued

| | | | | | |
|---|---|---|---|---|---|
| Extraction of straight-chain Paraffins | Aromatics (wt. %) | 8.2 | 9.3 | 6.7 | 6.4 |
| | (Method) | Process B after hydrogenation | Process B after hydrogenation | Process B after hydrogenation | Process B after hydrogenation |
| | Yield (wt. %) | 36.0 | 35.0 | 41.0 | 41.0 |
| | Purity (wt. %) | 99 | 99 | 99 | 99 |

| | | | Example 9 | Example 10 |
|---|---|---|---|---|
| | Feed Composition | Thermal-cracked oil distillate of (A) (vol. %) | 180°-220° C. Boiling Distillate (40) | (40) |
| | | Hydrocarbons of (B) (vol. %) | Xylene Fraction (60) | Benzene (60) |
| | Acid Catalyst Treatment | Catalyst | $AlCl_3$ 1.0 wt. % | HF |
| | | Treating Conditions | 80° C. × 1 hr | 5° C. × 1 hr |
| | Resultant Straight-chain Paraffin Producing Material | Yield | 62% | 65% |
| | | Hydrogenation | Unhydrogenated | Unhydrogenated |
| | | Bromine Number (cg/g) | 0.2 | 1.0 |
| | | Paraffins (straight-chain)(wt. %) | 93.3 (39.0) | 89.6 (38.0) |
| | | Olefins (wt. %) | 0.2 | 0.9 |
| | | Aromatics (wt. %) | 6.5 | 9.5 |
| | Extraction of straight-chain Paraffin | (Method) | Process B after hydrogenation | Process B after hydrogenation |
| | | Yield (wt. %) | 36.0 | 36.0 |
| | | Purity (wt. %) | 99 | 99 |

What is claimed is:

1. A method for increasing a concentration of straight-chain paraffin boiling in the range of 120° to 290° C. to 30 wt. % or more by reacting a thermal-cracked oil distillate boiling in the range of 120° to 290° C. and containing aliphatic olefins and a small amount of aromatics at a temperature of 0° to 330° C. in liquid phase in the presence of an acid catalyst, said thermal-cracked oil distillate being obtained from a delayed coking process of coking a patrolic heavy residual oil at a temperature not lower than 400° C. and not exceeding 700° C.; and then recovering by distillation a distillate boiling in the range of 120° C. to 290° C. from the acid catalyzed thermal-cracked oil distillate.

2. The method as set forth in claim 1, wherein said acid catalyst is a Friedel-Crafts catalyst.

3. The method as set forth in claim 2, wherein said Friedel-Crafts catalyst is selected from aluminum chloride, hydrogen fluroide, a complex thereof, and silica-alumina.

4. A method for increasing a concentration of a straight-chain paraffin boiling in the range of 120° to 290° C. to 30 wt. % or more by reacting a mixture containing aliphatic olefins and aromatics at a temperature of 0° to 330° C. in liquid phase in the presence of an acid catalyst to convert the aliphatic olefins and aromatics to heavier components by alkylation and oligomerization, said mixture comprising:

(A) at least 10% by weight of a thermal-cracked oil distillate boiling in the range of 120° to 290° C. and containing aliphatic olefins and a small amount of aromatics, said thermal-cracked oil distillate being obtained from a delayed coking process of coking a petrolic heavy residual oil at a temperature not lower than 400° C. and not exceeding 700° C., and (B) one or more members boiling lower than said thermal-cracked oil distillate (A) and selected from:

(a) a thermally-cracked by-product oil distillate obtained by thermal cracking of petrolic light oil at a temperature of 750° to 850° C., (b) a reformate distillate obtained by catalytic reforming of a petrolic light oil boiling in the range of 50° to 250° C. and (c) aromatic hydrocarbons, thereaftar recovering a distillate boiling in the range of 120° C. to 290° C. from the treated mixture by distillation.

5. The method as set forth in claim 4, wherein said acid catalyst is a Friedel-Crafts catalyst.

6. The method as set forth in claim 5, wherein said Friedel-Crafts catalyst is selected from aluminum chloride, hydrogen fluoride, a complex thereof, and silica-alumina.

* * * * *